US009556704B2

(12) United States Patent
Naedler et al.

(10) Patent No.: US 9,556,704 B2
(45) Date of Patent: Jan. 31, 2017

(54) EXPANDABLE FRACTURE PLUG SEAT APPARATUS

(71) Applicant: UTEX Industries, Inc., Houston, TX (US)

(72) Inventors: Mark H. Naedler, Cypress, TX (US); Derek L. Carter, Houston, TX (US); Thomas A. Goedrich, Bastrop, TX (US); Eddy J. Landry, III, Sealy, TX (US)

(73) Assignee: UTEX Industries, Inc., Houston, TX (US)

( * ) Notice: Subject to any disclaimer, the term of this patent is extended or adjusted under 35 U.S.C. 154(b) by 496 days.

(21) Appl. No.: 13/971,254

(22) Filed: Aug. 20, 2013

(65) Prior Publication Data

US 2014/0060813 A1 Mar. 6, 2014

Related U.S. Application Data

(60) Provisional application No. 61/697,390, filed on Sep. 6, 2012.

(51) Int. Cl.
*E21B 34/06* (2006.01)
*E21B 34/14* (2006.01)
(Continued)

(52) U.S. Cl.
CPC ..... *E21B 34/06* (2013.01); *E21B 33/134* (2013.01); *E21B 34/14* (2013.01); *E21B 43/26* (2013.01)

(58) Field of Classification Search
CPC ..... E21B 34/14; E21B 43/26
See application file for complete search history.

(56) References Cited

U.S. PATENT DOCUMENTS 2,743,905 A * 5/1956 Eckel ..... 166/325
2,947,363 A 8/1960 Sackett et al.
(Continued)

FOREIGN PATENT DOCUMENTS

CA 2771732 9/2012
JP 2006314708 11/2006
(Continued)

OTHER PUBLICATIONS

KIPO, International Search Report and Written Opinion, Application No. PCT/US2012/069883, Apr. 12, 2013.
(Continued)

*Primary Examiner* — Robert E Fuller
(74) *Attorney, Agent, or Firm* — Haynes & Boone, LLP

(57) ABSTRACT

An annular seat structure, for use in subterranean well stimulation operations, is operative in conjunction with associated expansion control structure to permit a predetermined number of fracture plug members to axially pass therethrough. In an illustrated embodiment thereof, the annular seat structure is movable between a retracted position having a first interior diameter, and a resiliently expanded position having a second, larger interior diameter. The seat structure has an annular array of rigid ring segments interdigitated with annular gaps that receive radially outwardly projecting portions of an annular resilient liner secured to radially inner surfaces of the rigid ring segments, the outwardly projecting liner portions being secured to circumferentially facing surfaces of the rigid ring segments. An annular spring member coaxially circumscribes the rigid ring segment array, is received in notches formed in the rigid segments, and resiliently biases the seat structure toward its retracted position.

20 Claims, 8 Drawing Sheets

(51) Int. Cl.
*E21B 43/26* (2006.01)
*E21B 33/134* (2006.01)

(56) References Cited

U.S. PATENT DOCUMENTS

| | | | | |
|---|---|---|---|---|
| 2,973,006 | A | 2/1961 | Nelson | |
| 3,054,415 | A | 9/1962 | Baker et al. | |
| 3,441,279 | A | 4/1969 | Lally et al. | |
| 3,554,281 | A | 1/1971 | Ecuer | |
| 3,568,768 | A | 3/1971 | Rowell, Jr. | |
| 3,667,505 | A | 6/1972 | Radig | |
| 3,885,627 | A | 5/1975 | Berry et al. | |
| 4,044,835 | A | 8/1977 | Mott | |
| 4,189,150 | A | 2/1980 | Langieri | |
| 4,252,196 | A | 2/1981 | Silberman et al. | |
| 4,292,988 | A | 10/1981 | Montgomery | |
| 4,448,216 | A | 5/1984 | Speegle et al. | |
| 4,510,994 | A | 4/1985 | Pringle | |
| 4,520,870 | A | 6/1985 | Pringle | |
| 4,537,383 | A | 8/1985 | Fredd | |
| 4,583,593 | A | 4/1986 | Zunkel et al. | |
| 4,593,914 | A * | 6/1986 | Johnson | E21B 33/03 277/322 |
| 4,828,037 | A | 5/1989 | Lindsey et al. | |
| 5,146,992 | A | 9/1992 | Baugh | |
| 5,165,473 | A | 11/1992 | Bode | |
| 5,226,539 | A | 7/1993 | Cheng | |
| 5,244,044 | A | 9/1993 | Henderson | |
| 5,297,580 | A | 3/1994 | Thurman | |
| 5,813,483 | A | 9/1998 | Latham et al. | |
| 5,960,881 | A | 10/1999 | Allamon et al. | |
| 6,003,607 | A | 12/1999 | Hagen et al. | |
| 6,032,734 | A | 3/2000 | Teifer | |
| 6,053,246 | A | 4/2000 | Echols et al. | |
| 6,053,250 | A | 4/2000 | Echols | |
| 6,155,350 | A | 12/2000 | Melenyzer | |
| 6,189,618 | B1 | 2/2001 | Beeman et al. | |
| 6,227,298 | B1 | 5/2001 | Patel | |
| 6,230,807 | B1 | 5/2001 | Patel | |
| 6,390,200 | B1 | 5/2002 | Allamon et al. | |
| 6,662,877 | B2 | 12/2003 | Patel | |
| 6,681,860 | B1 | 1/2004 | Yokley et al. | |
| 6,695,066 | B2 | 2/2004 | Allamon et al. | |
| 6,725,935 | B2 | 4/2004 | Szarka et al. | |
| 6,769,490 | B2 | 8/2004 | Allamon et al. | |
| 6,799,638 | B2 | 10/2004 | Butterfield, Jr. | |
| 6,866,100 | B2 | 3/2005 | Gudmestad et al. | |
| 6,966,368 | B2 | 11/2005 | Farquhar | |
| 7,021,389 | B2 | 4/2006 | Bishop et al. | |
| 7,134,505 | B2 | 11/2006 | Fehr et al. | |
| 7,464,764 | B2 | 12/2008 | Xu | |
| 7,503,392 | B2 | 3/2009 | King et al. | |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 7,647,964 | B2 | 1/2010 | Akbar et al. | |
| 7,673,677 | B2 | 3/2010 | King et al. | |
| 7,681,645 | B2 | 3/2010 | McMillin et al. | |
| 7,694,732 | B2 | 4/2010 | Rogers et al. | |
| 7,921,922 | B2 | 4/2011 | Darnell et al. | |
| 8,151,891 | B1 | 4/2012 | Darnell et al. | |
| 8,261,761 | B2 | 9/2012 | Gerrard et al. | |
| 8,276,675 | B2 | 10/2012 | Williamson et al. | |
| 8,403,068 | B2 | 3/2013 | Robison et al. | |
| 8,479,808 | B2 | 7/2013 | Gouthaman | |
| 8,479,823 | B2 | 7/2013 | Mireles | |
| 8,668,006 | B2 | 3/2014 | Xu | |
| 8,950,496 | B2 | 2/2015 | Kitzman | |
| 9,004,179 | B2 | 4/2015 | Chauffe | |
| 9,234,406 | B2 | 1/2016 | Naedler et al. | |
| 9,316,084 | B2 | 4/2016 | Carter et al. | |
| 9,353,598 | B2 | 5/2016 | Naedler et al. | |
| 9,382,787 | B2 | 7/2016 | Naedler et al. | |
| 2002/0043368 | A1 | 4/2002 | Bell et al. | |
| 2005/0072572 | A1 | 4/2005 | Churchill | |
| 2005/0126638 | A1 | 6/2005 | Gilbert | |
| 2006/0213670 | A1 | 9/2006 | Bishop et al. | |
| 2006/0243455 | A1 | 11/2006 | Telfer et al. | |
| 2007/0017679 | A1 | 1/2007 | Wolf et al. | |
| 2007/0181188 | A1 | 8/2007 | Branch et al. | |
| 2008/0066924 | A1 | 3/2008 | Xu | |
| 2008/0093080 | A1 | 4/2008 | Palmer et al. | |
| 2008/0217025 | A1 | 9/2008 | Ruddock et al. | |
| 2009/0044946 | A1 | 2/2009 | Schasteen et al. | |
| 2009/0044949 | A1 | 2/2009 | King et al. | |
| 2009/0044955 | A1 | 2/2009 | King et al. | |
| 2009/0159289 | A1 | 6/2009 | Avant et al. | |
| 2009/0308588 | A1 | 12/2009 | Howell et al. | |
| 2010/0101803 | A1 | 4/2010 | Clayton et al. | |
| 2010/0132954 | A1 | 6/2010 | Telfer | |
| 2010/0212911 | A1 | 8/2010 | Chen et al. | |
| 2010/0282338 | A1 | 11/2010 | Gerrard et al. | |
| 2011/0067888 | A1 | 3/2011 | Mireles | |
| 2011/0108284 | A1 | 5/2011 | Flores et al. | |
| 2011/0180270 | A1 | 7/2011 | Martin et al. | |
| 2011/0192607 | A1 | 8/2011 | Hofman et al. | |
| 2011/0192613 | A1 | 8/2011 | Garcia et al. | |
| 2011/0278017 | A1 | 11/2011 | Themig et al. | |
| 2011/0315389 | A1 | 12/2011 | Crider et al. | |
| 2011/0315390 | A1 | 12/2011 | Guillory et al. | |
| 2012/0048556 | A1 | 3/2012 | O'Connell et al. | |
| 2012/0097265 | A1 | 4/2012 | Gerrard et al. | |
| 2012/0181032 | A1 | 7/2012 | Naedler et al. | |
| 2012/0227973 | A1* | 9/2012 | Hart | E21B 21/103 166/329 |
| 2012/0261131 | A1 | 10/2012 | Hofman et al. | |
| 2012/0305236 | A1 | 12/2012 | Gouthaman | |
| 2012/0305265 | A1 | 12/2012 | Garcia et al. | |
| 2013/0025868 | A1 | 1/2013 | Smith et al. | |
| 2013/0118732 | A1 | 5/2013 | Chauffe et al. | |
| 2013/0133876 | A1 | 5/2013 | Naedler et al. | |
| 2013/0153220 | A1 | 6/2013 | Carter et al. | |
| 2013/0186633 | A1 | 7/2013 | Kitzman | |
| 2013/0186644 | A1 | 7/2013 | Smith et al. | |
| 2013/0299199 | A1 | 11/2013 | Naedler et al. | |
| 2014/0060813 | A1 | 3/2014 | Naedler et al. | |
| 2015/0068762 | A1 | 3/2015 | Naedler | |
| 2015/0176361 | A1 | 6/2015 | Prosser et al. | |
| 2015/0191998 | A1 | 7/2015 | Naedler et al. | |
| 2016/0002995 | A1 | 1/2016 | Naedler et al. | |

FOREIGN PATENT DOCUMENTS

| | | |
|---|---|---|
| WO | WO 00/63526 | 10/2000 |
| WO | WO 2009/067485 | 5/2009 |
| WO | WO 2013/090805 | 6/2013 |

OTHER PUBLICATIONS

International Search Report and Written Opinion issued for PCT/US2013/056185 dated Jan. 29, 2014, 9 pgs.

* cited by examiner

EXPANDABLE FRACTURE PLUG SEAT APPARATUS

CROSS-REFERENCE TO RELATED APPLICATION

The present application claims the benefit of the filing date of provisional U.S. patent application No. 61/697,390 filed Sep. 6, 2012. The entire disclosure of the provisional application is hereby incorporated herein by this reference.

BACKGROUND

The present invention generally relates to subterranean well fracturing operations and, in representatively illustrated embodiments thereof, more particularly relates to specially designed expandable fracture plug seat structures and associated apparatus for operatively supporting them downhole and selectively permitting and precluding expansion thereof.

In subterranean well stimulation, the ability to perforate multiple zones in a single well and then fracture each zone independently, (typically referred to as "zone" fracturing), has desirably increased access to potential hydrocarbon reserves. Many gas wells are drilled with zone fracturing planned at the well's inception. Zone fracturing helps stimulate the well by creating conduits from the formation for the hydrocarbons to reach the well. A well drilled with planned fracturing zones will be equipped with a string of piping below the cemented casing portion of the well. The string is segmented with packing elements, fracture plugs and fracture plug seat assemblies to isolate zones. A fracture plug, such as a ball or other suitably shaped structure (hereinafter referred to collectively as a "ball") is dropped or pumped down the well and seats on the fracture plug seat assembly, thereby isolating pressure from above.

In order to progressively fracture successive subterranean zones along the length of the wellbore it is necessary to construct the ball seat so that its annular shape is diametrically expandable to permit one or more fracture balls to be forced therethrough on their way to expandable plug seats further downhole to sealingly seat on these lower seats. It is further necessary to selectively preclude diametrical expansion of the seats to permit this sealing engagement between a fracture ball and the seat.

Previously proposed expandable fracture ball seats of this general type have been subject to well known problems, limitations and disadvantages. For example, in order to permit the necessary diametrical expansion of a ball seat it is typically necessary to form one or more radial slits therein which widen as the fracture ball passes through the seat. These necessarily widened slits have proven to be susceptible to having well debris lodged therein which can undesirably prevent proper complete closure of the gaps, when the seat returns to its smaller diameter relaxed position, thereby denigrating the requisite sealing capability of the seat when it is called upon to be sealingly engaged by a fracture ball plug (i.e., when the ball is acting as a plug) and prevent its passage through the circular seat opening.

Additionally, during the high pressure injection of frac slurry into a perforated downhole formation, the plug seat is subject to an abrasive blasting effect of the slurry. In conventionally designed plug seats this causes erosion of the seats, thereby lessening their plug sealing ability. Moreover, conventionally constructed plug seats, due to the driving pressure exerted on the ball plugs, may create stress concentrations on the balls sufficient to deform them and thereby substantially reduce the sealing capability of the associated ball seat.

As can be seen from the foregoing, a need exists for an improved expandable fracture ball seat structure which eliminates or at least reduces the aforementioned problems, limitations and disadvantages associated with previously proposed expandable fracture plug seats as generally described above. It is to this need that the present invention is primarily directed.

DETAILED DESCRIPTION

Figure 1:
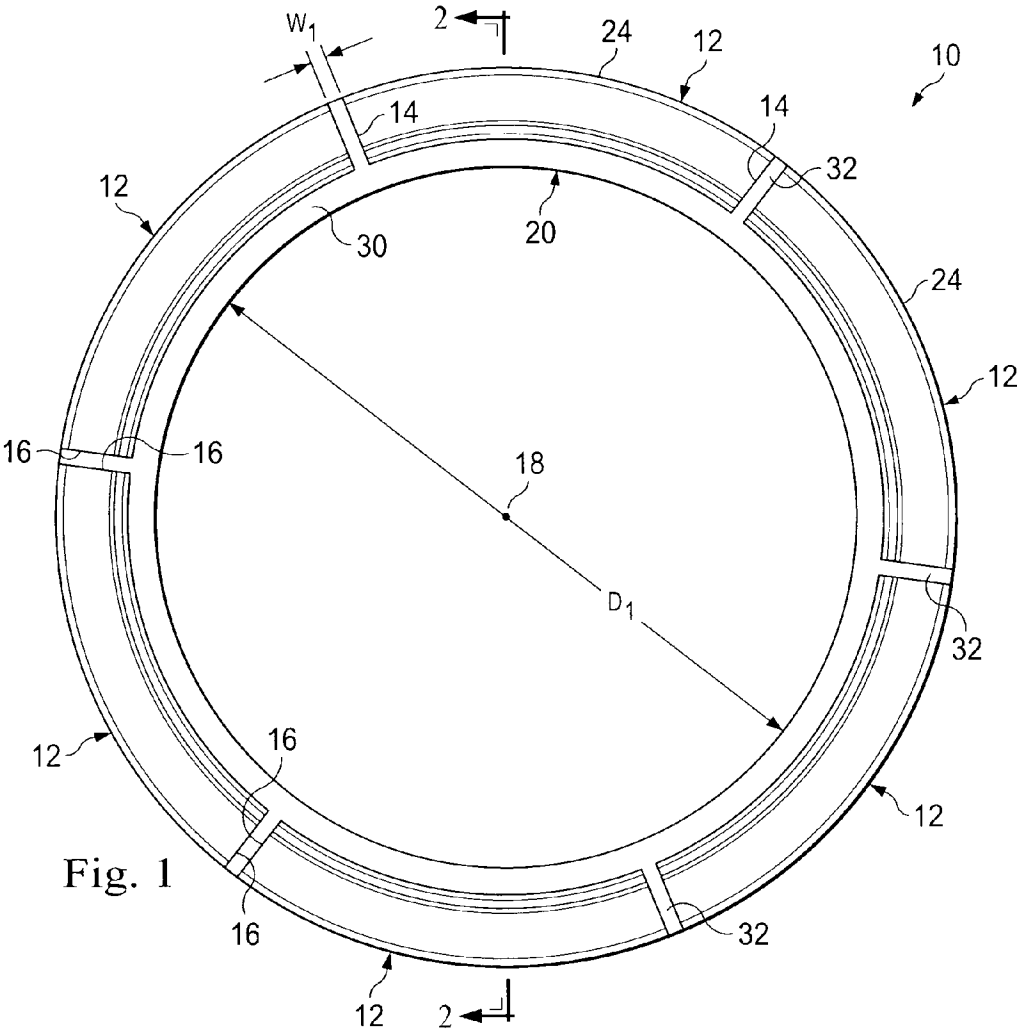
FIG. 1 is a ball entry side elevational view of a specially designed expandable annular fracture ball seat embodying principles of the present invention, the seat being in its relaxed, retracted position.
Figure 2:
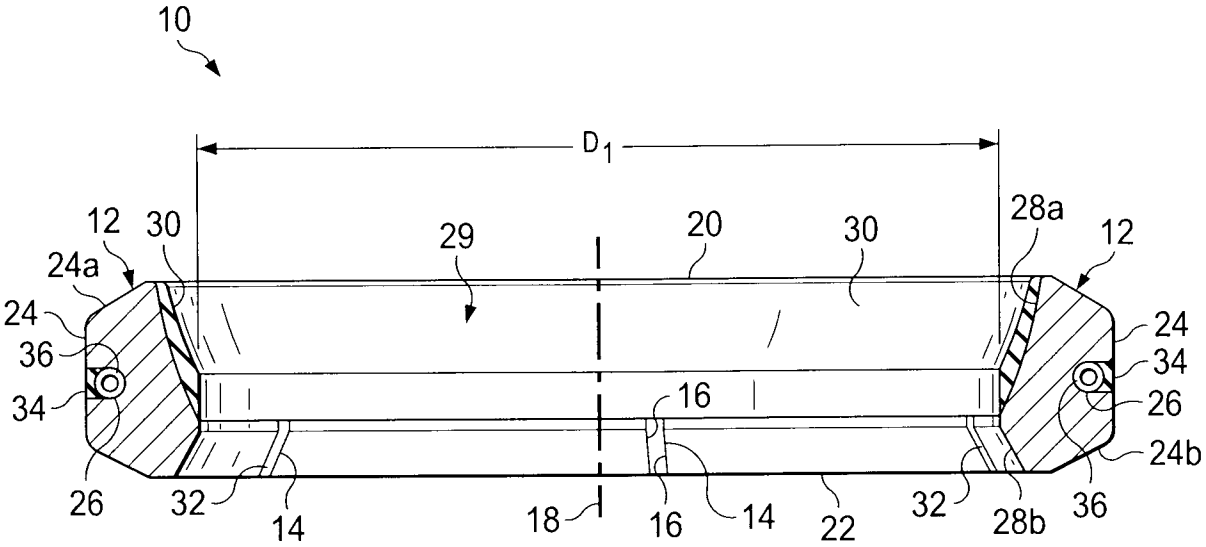
FIG. 2 is a cross-sectional view through the ball seat taken along line 2-2 of FIG. 1.

With initial reference to FIGS. 1 and 2, in an illustrative embodiment thereof the present invention provides a specially designed fracture ball plug seat structure 10 having an overall annular configuration. Seat 10, depicted in FIGS. 1 and 2 in its diametrically relaxed position, is particularly well suited to downhole well "zone" fracturing operations and includes an annular circumferentially spaced apart array of rigid arcuate ring segments 12 formed from a high modulus material such as metal, with a series of circumferential gaps 14 being interdigitated with the segments 12. Each of the gaps 14 has a width $W_1$ and is circumferentially bounded by opposing end surfaces 16 of a circumferentially adjacent pair of the ring segments 12.

Still referring to FIGS. 1 and 2, the seat structure 10 circumscribes an axis 18 and has a ball entry side 20 and a ball exit side 22. Each of the rigid ring segments 12 has a radially outer side surface 24 with a circumferentially extending groove 26 formed therein, and a radially inner side surface 28 having an annular portion **28*a* that slopes radially outwardly toward the ball entry side 20 of the seat structure 10, and an annular portion 28*b* that slopes radially outwardly from the axially inner periphery of the annular portion 28*a* to the ball exit side 22 of the seat structure 10. The radially outer side surface 24 has a sloping ball entry side annular corner surface portion 24*a*, and an oppositely sloping ball exit side annular corner surface portion 24*b***.

The seat structure 10, in addition to the rigid portion thereof defined by the rigid ring segments 12, has a resilient portion 29, formed from a suitable low modulus elastomeric material such as rubber, comprising an inner annular resilient ring member 30, a circumferentially spaced array of resilient members 32 projecting radially outwardly from the inner ring member 30 and extending through and substantially filling the ring gaps 14, and a resilient outer ring member 34.

In the representative seat structure embodiment 10 shown in FIGS. 1 and 2, the resilient structures 30, 32 and 34 are integral sections of the overall resilient portion 29, with the inner ring member 30 being bonded to the radially inner ring segment surface portions 28*a*, each of the radially extending portions 32 being bonded to the facing end surfaces 16 of a circumferentially adjacent pair of the ring segments 12, and the outer ring member 34 being received in the ring segment grooves 26.

Additionally, an annular spring structure, representatively a garter spring 36, may be provided and is received in the ring segment grooves 26 and embedded in the resilient outer ring member 34. The fracture ball plug seat structure 10 may be conveniently fabricated by an over-molding process in which the resilient portion 29 of the seat is flowed into place against and appropriately bonded to the annular array of rigid ring segments 12 and encapsulates the garter spring 36. The resilient structure portion 29 of the seat 10 (along with the spring 36 if utilized) resiliently retains the seat in its relaxed, retracted position, shown in FIGS. 1 and 2, in which the seat has a minimum diameter $D_1$ extending between facing portions of the radially inner surface of the inner resilient ring 30.

Figure 3:
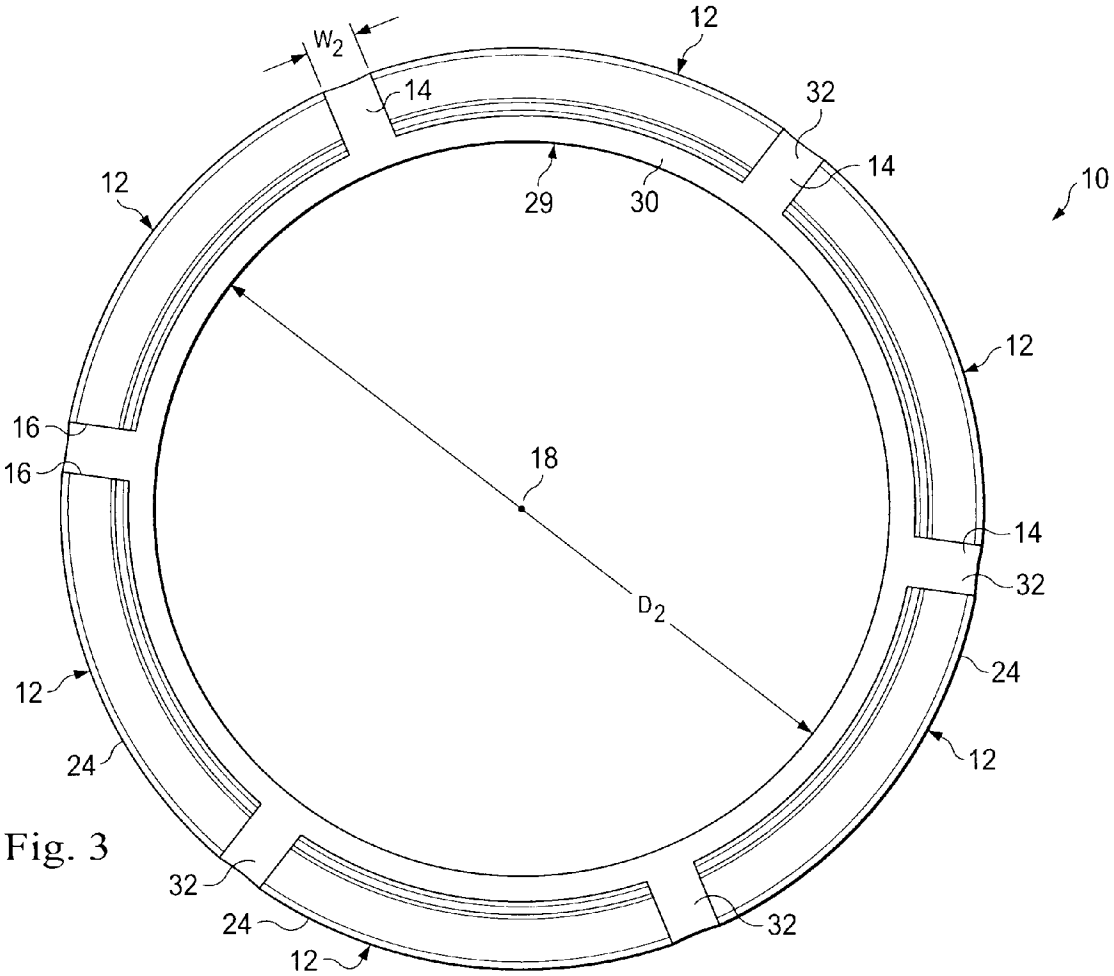
FIG. 3 is a ball entry side elevational view of the ball seat in a resiliently expanded, diametrically enlarged position.

When, as subsequently described herein, a plug ball having a diameter greater than $D_1$ is operatively forced through the seat 10, the ball diametrically expands the seat 10 (as shown in FIG. 3) in a manner increasing its minimum inner diameter to $D_2$, increasing the ring gap widths to $W_2$, and widening the resilient radial projections 32 to widths $W_2$, against the yielding resistive force of the resilient portion 29 and the spring 36.

Figure 4:
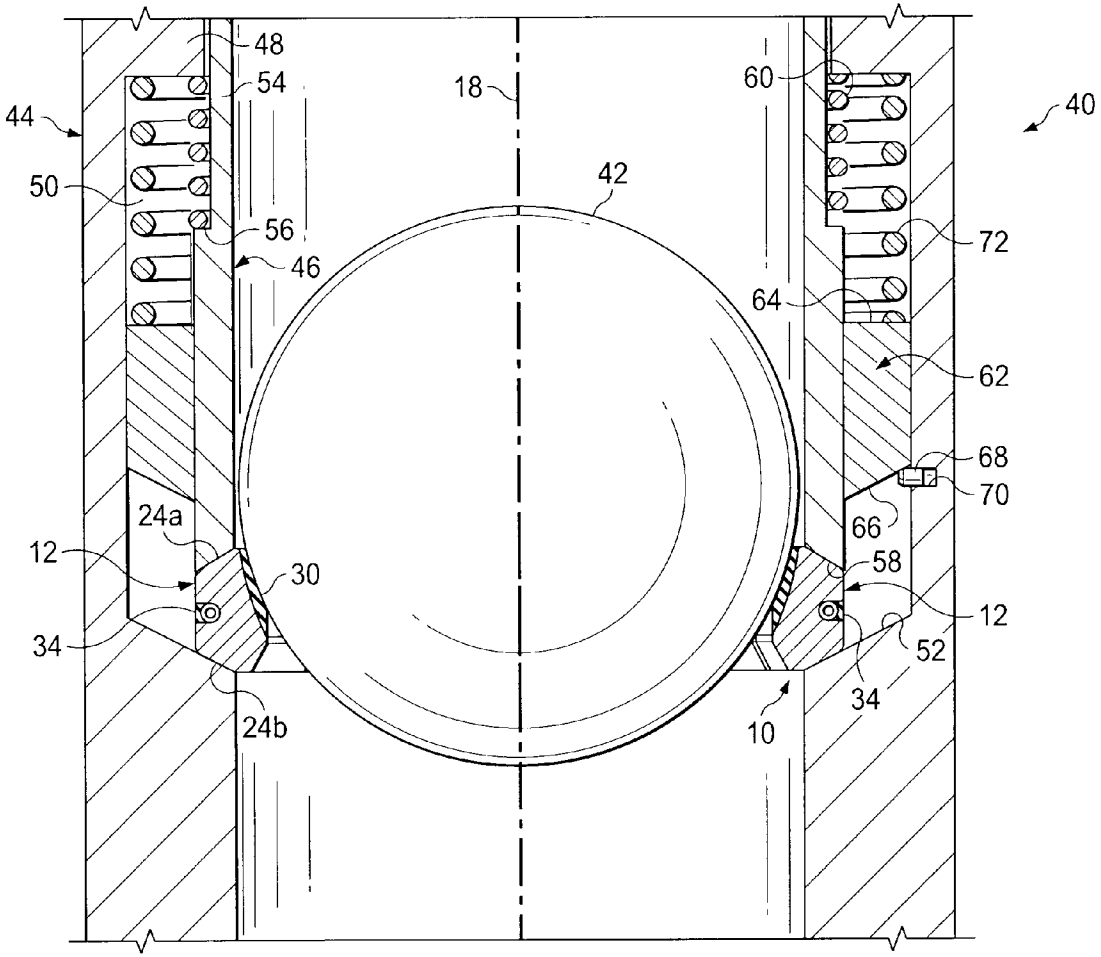
FIGS. 4-6 are simplified, partially schematic cross-sectional views through the ball seat operatively supported in a representative expansion control structure, and respectively illustrate a ball plug member (1) initially engaging the seat, (2) expanding and downwardly passing through the seat, and (3) sealingly engaging the seat when it is precluded from diametrically expanding.
Figure 5:
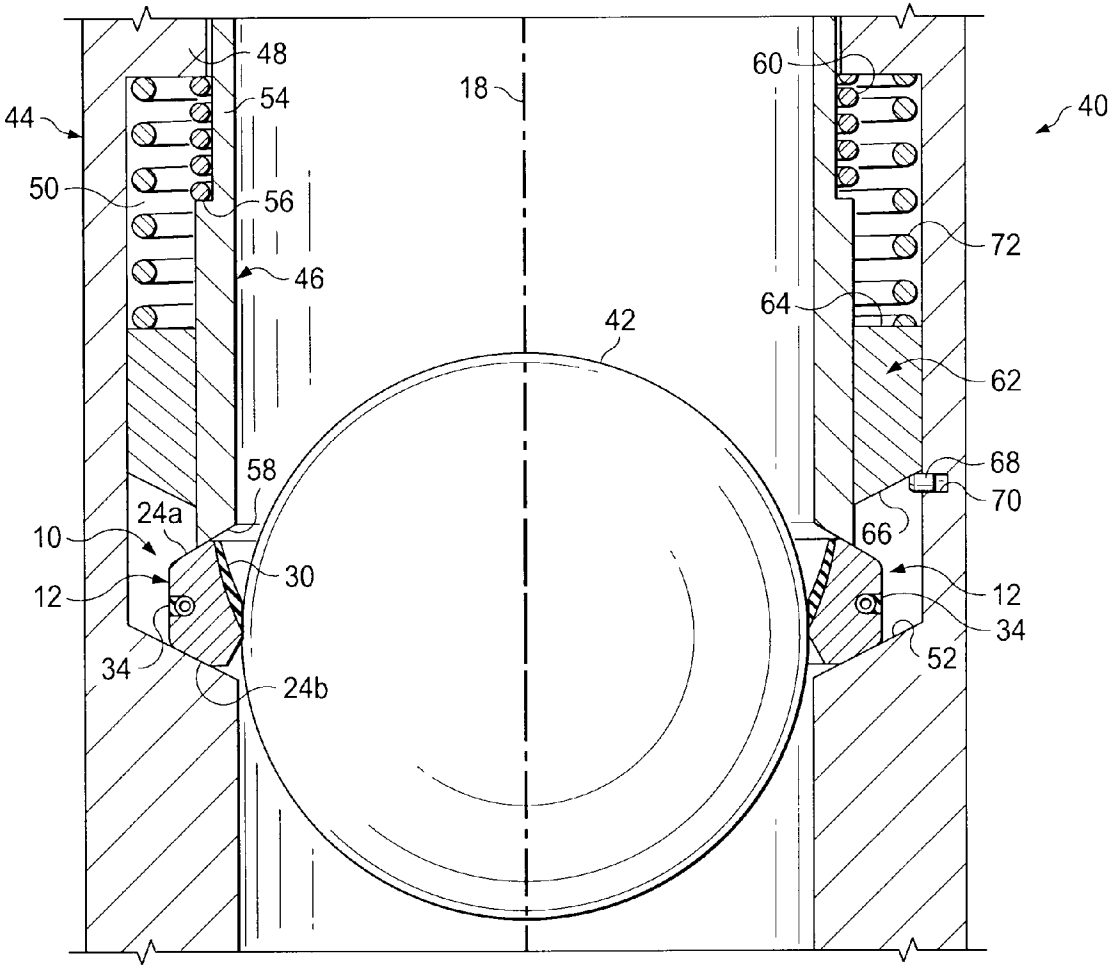
Figure 6:
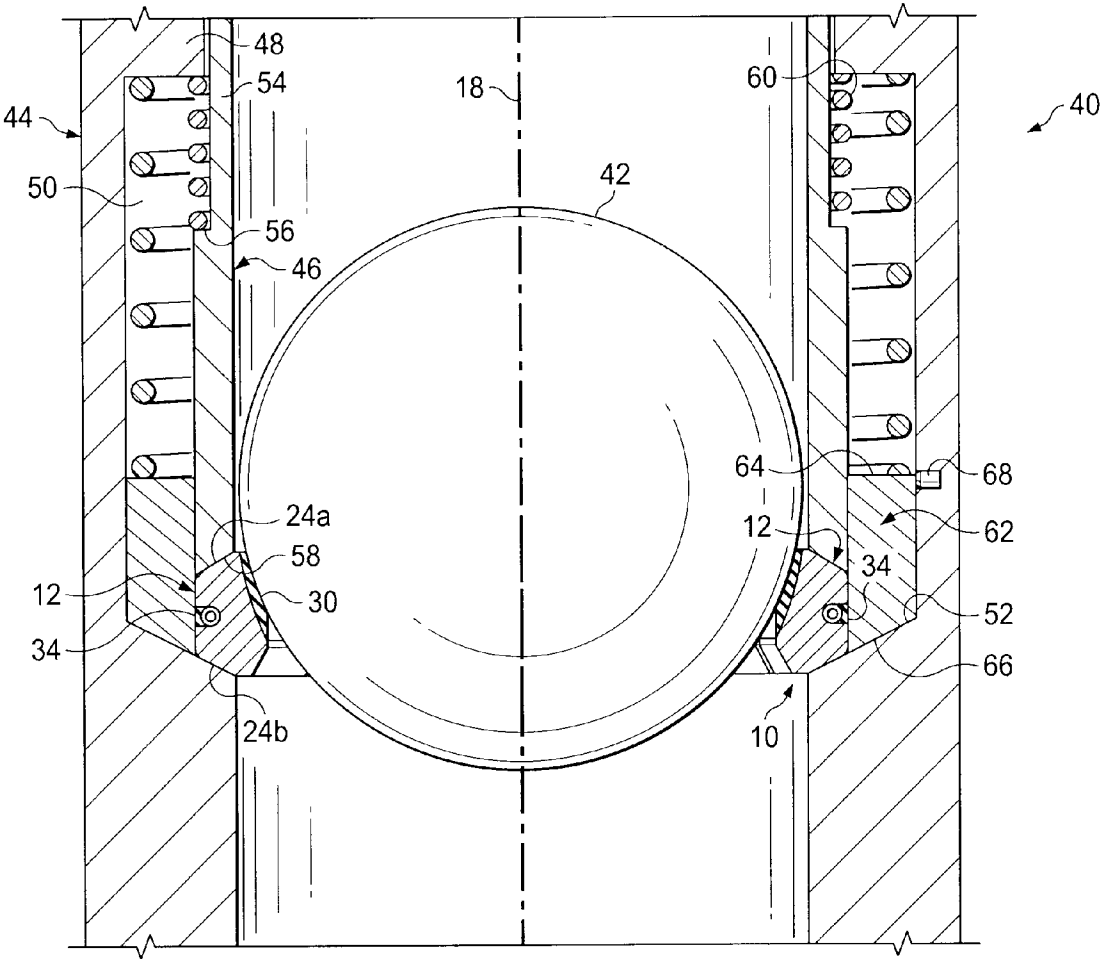

FIGS. 4-6 illustrate the seat structure 10 coaxially received in and operatively engaging a representative expansion control structure 40. FIG. 4 illustrates a plug ball 42 initially engaging the seat structure 10 in a downhole direction and having a diameter greater than the relaxed inner diameter $D_1$ of the seat structure 10. FIG. 5 illustrates the ball 42 passing in the downhole direction through the seat structure 10 and diametrically expanding it as the plug ball 42 passes therethrough. FIG. 6 illustrates the seat structure 10 sealingly engaged with the plug ball 42, with the expansion control structure blocking the downhole passage of the plug ball 42 through the seat structure 10.

Returning now to FIG. 4, the expansion control structure 40 which internally and coaxially supports the seat structure 10 for operative engagement with the plug ball 42 comprises an outer tubular member 44, and an inner tubular member 46 slidingly telescoped therein.

Outer tubular member 44 has, at its upper end, an inturned annular flange 48 that defines in the interior of the outer tubular member 44 the upper end of a radially outwardly enlarged annular pocket area 50 terminating at its lower end at an annular ledge surface 52 that slopes downwardly and radially inwardly at an angle substantially identical to the slope angle of the corner surfaces 24*b* of the rigid ring segments 12 of the seat structure 10.

Inner tubular member 46 is axially shorter than the outer tubular member 44 and has a radially inwardly thinned upper end portion 54 defining at its lower end an annular upwardly facing ledge 56. At the lower end of the inner tubular member 46 is a downwardly and radially outwardly sloped end surface 58 having a slope angle substantially identical to the slope angle of the corner surfaces 24*a* of the rigid ring segments 12 of the seat structure 10. When the seat structure 10 is initially installed in the expansion control structure 40, as shown in FIG. 4, the rigid seat structure ring segments 12 are interposed between the annular surfaces 52 and 58 of the outer and inner tubular members 44 and 46. A helical spring 60 disposed in the annular pocket area 50 bears at its opposite ends against the underside of the annular flange 48 and the annular ledge 56, and holds the sloped outer and inner tubular member surfaces 52 and 58 slidingly against the complementarily sloped surfaces 24*b* and 24*a* of the rigid seat structure ring segments 12, respectively. The compression from the sloped surfaces 52,58 keep the seat structure 10 axially aligned.

The expansion control structure 40 further comprises an annular locking ring member 62 having a flat annular upper side surface 64, and a bottom side surface 66 that slopes downwardly and radially inwardly at a slope angle substantially identical to the slope angle of the outer tubular member surface 52. Locking ring member 62 is coaxially and slidingly received in the annular pocket area 50 in an upwardly spaced apart relationship with the annular sloped surface 52 of the outer tubular member 44, and is releasably held in its FIG. 4 position, against further downward movement toward the sloped outer tubular member surface 52, by a suitable restraining mechanism.

Representatively, but not by way of limitation, such restraining mechanism may take the form of a pin member 68 slidingly received in a bore 70 formed in the inner side surface of the outer tubular member 44 above its sloped interior surface 52. When the seat structure 10 is initially installed in the expansion control structure 40, the pin 68 is releasably locked in a suitable manner in its FIG. 4 position in which it projects inwardly into the pocket area 50 and acts as an abutment that precludes downward movement of the locking ring member 62 past its FIG. 4 position. A compressed helical spring 72 coaxially disposed in the pocket area 50 bears at its opposite ends against the underside of the annular flange 48 and the upper side 64 of the locking ring 62 and exerts a resilient downwardly directed force thereon.

Turning now to FIG. 5, as the ball 42 is driven further downwardly from its initial seat structure engaging position shown in FIG. 4 (by, for example, fluid pressure exerted on the uphole side of the ball 42) the ball 42 is forced downwardly through the seat structure 10, expanding it in a manner radially outwardly by driving the rigid ring segments 12 into the pocket area 50, and thus permitting the ball 42 to pass downwardly through and exit the seat structure 10. The forcible movement of the rigid ring segments 12 into the pocket area 50, by virtue of the sliding engagement of the sloped surface pairs 24*a*,58 and 24*b*,52, causes an axially upwardly directed translation of the inner tubular member 46 relative to the outer tubular member 44, thereby further compressing the spring 60. The compression of the spring 60, in turn, forcibly creates annular seal areas at the annular surface pairs 24*a*,58 and 24*b*,52 to desirably keep pressurized fluid above the seat structure from entering the pocket area 50. After the ball 42 has passed downwardly through the seat structure 10, the seat structure 10 and the components of the expansion control structure 40 return to their FIG. 4 orientations via the downward force exerted on the inner tubular member 46 by the compressed spring 60.

With reference now to FIG. 6, when it is desired to preclude the downhole passage of a ball 42 through the seat structure 10 (with the seat structure 10 and the expansion control structure 40 in their previously described FIG. 4 orientations), the retaining pin 68 is retracted in a suitable manner to its FIG. 6 orientation in which it is withdrawn into the bore 70 so it no longer projects into the pocket area 50 in an underlying abutment position relative to the locking ring 62. This permits the locking ring 62 to be moved downwardly from its FIG. 4 position to its FIG. 6 position in which the locking ring 62 now forms an annular radially outward abutment that prevents the seat structure 10 from being expanded to an outer diameter greater than its relaxed position outer diameter. Since the ball 42 illustrated in FIG. 6 has a diameter greater than the minimum interior diameter $D_1$ of the seat structure 10 in its relaxed position, the ball 10 now is precluded from passing in a downhole direction through the seat structure 10 and forms a plug seal between the interior portion of the inner tubular member 46 above the seat structure 10 and the interior portion of the inner tubular member 46 below the seat structure 10.

The representative fracture ball plug seat structure embodiment 10 described above is of a simple composite structure and utilizes hard metallic (or other suitable rigid material) segments with soft elastomer material (illustratively rubber) to serve as a binder and shield. The soft elastomeric material has the elasticity to expand and contract without yielding, while the metallic segments have the rigidity and strength to adequately support the ball. The elastomeric material between the metallic segments could be bonded to each adjacent metallic segment (as shown for the seat structure 10). In this case, the elastomeric material prevents a gap from occurring during seat expansion, thereby preventing debris from lodging between the metallic segments. It is also possible to not bond the elastomeric material to the adjacent ends of the metallic segments (as subsequently illustrated and described herein). In the event that debris does become lodged between the metallic segments, the debris would simply embed into the elastomeric material and still allow the metallic segments to retract to their original positions.

Another benefit of this design is the elastomeric material which is preferably over-molded and bonded to the surface receiving the plug ball. The resulting resilient ball-contacting seat surface endures a blasting effect from frac fluid (a water/sand slurry) during a frac operation. Unlike a rigid metal, which tends to eventually erode in these conditions, the elastomeric material serves as a liner and absorbs the energy from the slurry grit, then lets the grit bounce off harmlessly. The elastomeric surface receiving the ball also desirably serves as a cushion to protect the ball from stress concentrations that might occur from the rigid metallic segments. The elastomeric seat material also insures a leak free seal to prevent high pressure washout while the ball is acting as a plug.

An annular array of circumferential grooves is formed when the metallic segments are aligned in position for the subsequent elastomeric material over-molding process. Optionally, elastomeric material and/or an annular spring member can be placed in these grooves to help align the segments and maintain additional cinching force on the segments to insure that the seat returns to its molded position from a diametrically expanded position. At least one side of the seat (for example the ball entry side of the seat) may be beveled so that axial force from the adjacent component in the assembly will also force the metallic segments to their most inward positions. The beveled surface also helps keep the seat structure concentric in all positions.

Figure 7:
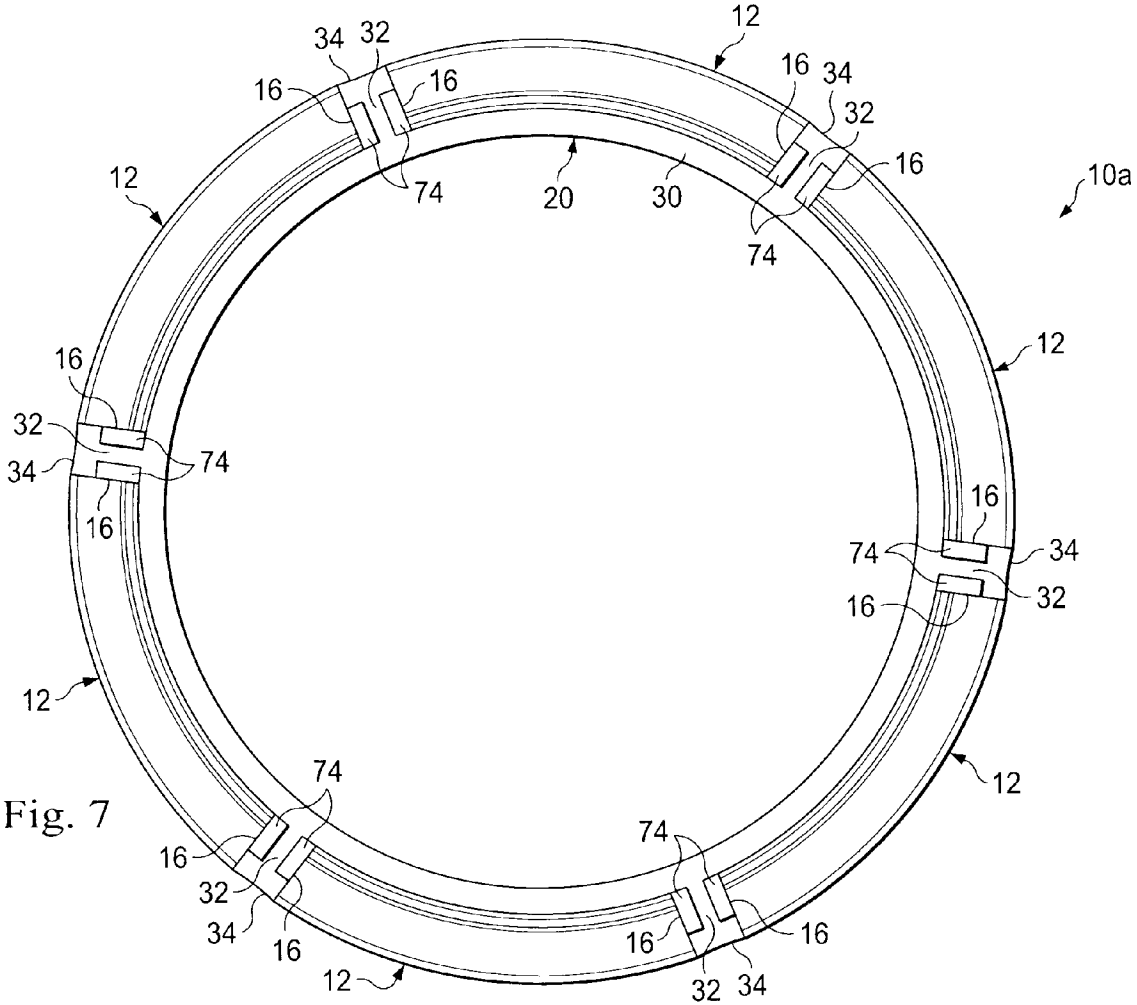
FIG. 7 is a ball entry side elevational view of a first alternate embodiment of the expandable ball seat in a diametrically expanded position thereof.

A first alternate embodiment 10*a* of the previously described seat structure 10 is shown in FIG. 7 in a diametrically expanded position thereof. The seat 10*a* is identical to the seat 10 with the exception that in the seat 10*a* the resilient radial elastomeric material projections 32 are not bonded to their associated circumferentially adjacent rigid ring segment end surfaces 16. Accordingly, when the seat structure 10*a* is diametrically expanded as shown in FIG. 7, voids 74 are created between each resilient material projection 32 and the ring segment end surfaces 16 on opposite sides thereof. These voids 74 advantageously decrease the force which must be exerted on the seat 10*a* to operatively expand it. As previously discussed, while this lack of bonding of the projections 32 to the ring segments 12 can potentially permit some debris into the gaps between the facing ring segment end surfaces 16, such debris will embed in the projections 32 and still allow the ring segments 12 to retract to their original positions.

Figure 8:
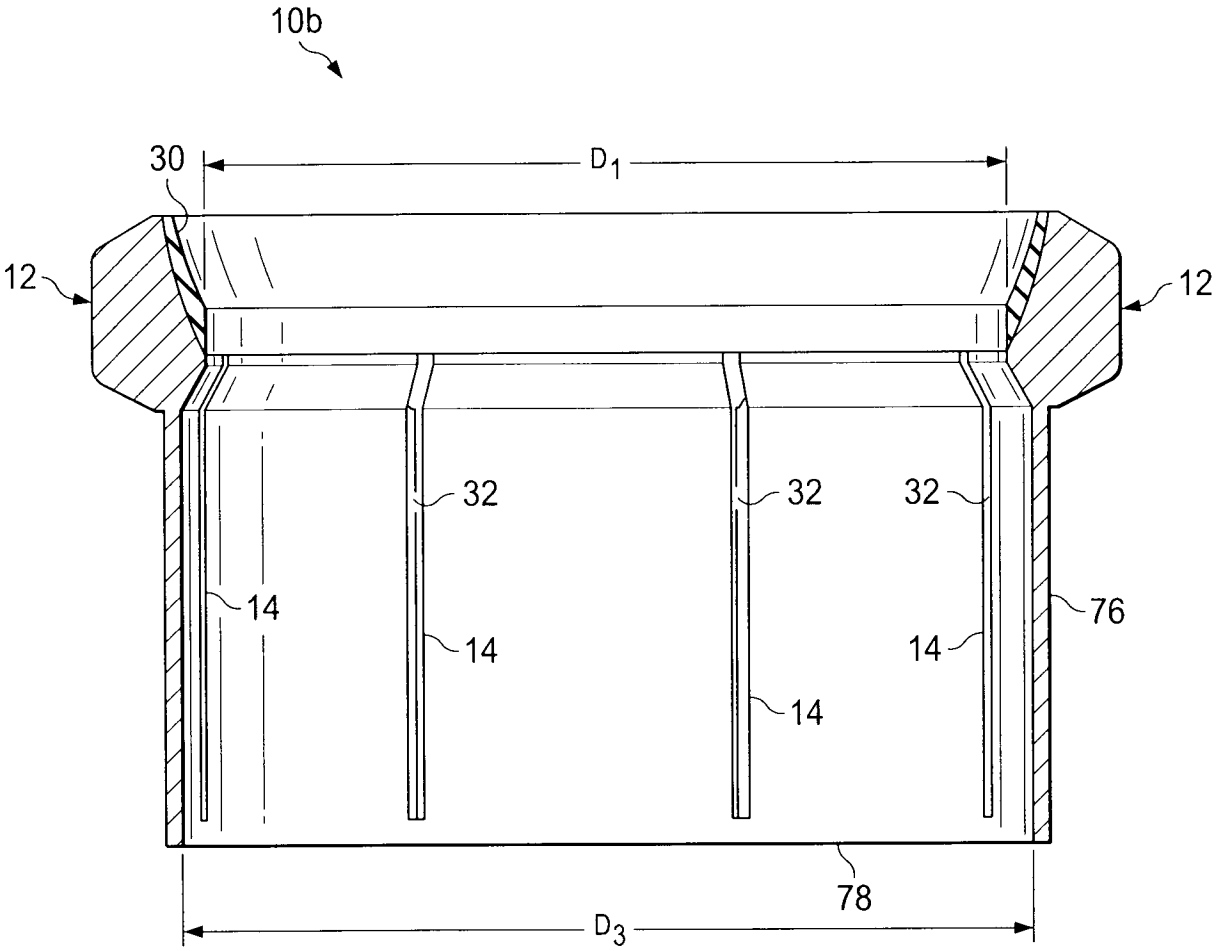
FIG. 8 is a radially directed cross-sectional view through a second alternate embodiment of the expandable ball seat in its relaxed position.

A second alternate embodiment 10*b* of the previously described expandable seat structure 10 is cross-sectionally illustrated in FIG. 8. Seat structure 10*b* is identical to the previously described seat structure 10 with the exception that the rigid portion of the seat structure 10*b* comprises, in addition to the circumferentially spaced array of rigid metal ring segments 12, a depending tubular metallic collet collar 76 formed integrally with the ring segments 12 and having an interior diameter $D_3$ larger than the minimum interior diameter $D_1$ of the upper ring segment portion of seat structure 10*b*. Accordingly, the rigid portion of the seat structure 10*b* is of a unitary construction which simplifies the overall construction of the seat structure 10*b*.

As can be seen in FIG. 8, the ring segment gaps 14 incorporated in the seat structure 10 and implemented in the seat structure 10*b* are carried downwardly through the annular wall of the collar 76 in the seat structure 10*b* to just above its open lower end 78, thereby giving the collar 76 its collet-like configuration.

It is to be noted that when the upper ring segment portion of the seat structure embodiment 10*b* is diametrically expanded, the collar 76 diametrically expands as well. The elastomeric material 32 disposed in the ring gaps 14 of the upper ring portion of the seat structure 10*b* (see FIG. 1) may be carried down through the downward extensions of the gaps 14 in the collar 76 if desired.

The foregoing detailed description is to be clearly understood as being given by way of illustration and example only, the spirit and scope of the present invention being limited solely by the appended claims.

What is claimed is:

1. Expandable fracture plug seat apparatus comprising:

an annular array of rigid ring segments having radially inner and outer surfaces and being interdigitated with an annular array of circumferential gaps radially extending between facing end surfaces of said rigid ring segments, said radially outer surfaces having notches formed therein;

an annular resilient liner secured to said radially inner surfaces of said rigid ring segments;

an annular spring structure coaxially circumscribing said annular array of rigid ring segments and extending through said notches in said radially outer surfaces of said rigid ring segments; and a circumferentially spaced series of resilient sections extending radially outwardly from said annular resilient liner and received in said circumferential gaps, said fracture plug seat apparatus having (1) a retracted position in which said annular resilient liner has a first minimum interior diameter and said circumferential gaps have first circumferential widths, and (2) a resiliently expanded position in which said annular resilient liner has a second minimum interior diameter greater than said first minimum interior diameter, and said circumferential gaps have second circumferential widths greater than said first circumferential widths, said annular spring structure resiliently urging said fracture plug seat apparatus toward said retracted position thereof.

2. The expandable fracture plug seat apparatus of claim 1 wherein:

each of said resilient sections is secured to a facing pair of said rigid ring segment end surfaces circumferentially bounding the circumferential gap through which the resilient section radially extends.

3. The expandable fracture plug seat apparatus of claim 2 wherein:

each of said resilient sections is formed integrally with said annular resilient liner.

4. The expandable fracture plug seat apparatus of claim 2 wherein:

each of said resilient sections substantially fills its associated circumferential gap.

5. The expandable fracture plug seat apparatus of claim 1 wherein:

each of said rigid ring segments is formed from a metal material.

6. The expandable fracture plug seat apparatus of claim 1 wherein:

said annular resilient liner and said resilient sections are formed from an elastomeric material.

7. The expandable fracture plug seat apparatus of claim 6 wherein:

said resilient sections are integral portions of said annular resilient liner.

8. The expandable fracture plug seat apparatus of claim 1 wherein:

said annular spring structure is a garter spring.

9. The expandable fracture plug seat apparatus of claim 1 wherein:

said expandable fracture plug seat apparatus circumscribes an axis, and has first and second sides spaced apart along said axis, and said radially inner surfaces of said rigid ring segments have portions which slope radially inwardly and axially toward said second side of said expandable fracture plug seat apparatus from said first side of said expandable fracture plug seat apparatus.

10. The expandable fracture plug seat apparatus of claim 9 wherein:

said annular resilient liner is secured to said portions of said radially inner surfaces of said rigid ring segments.

11. The expandable fracture plug seat apparatus of claim 10 wherein:

said portions of said radially inner surfaces of said rigid ring segments are first portions thereof, and said radially inner surfaces of said rigid ring segments further have second portions that slope radially inwardly and axially toward said first side of said expandable fracture plug seat apparatus from said second side of said expandable fracture plug seat apparatus.

12. The expandable fracture plug seat apparatus of claim 1 further comprising:

a tubular collar section coaxially secured to said annular array of rigid ring segments and defining an axial extension thereof, said tubular collar section having an annular array of circumferentially spaced axially extending slits that communicate with said circumferential gaps and have a resilient material received therein.

13. A fracturing system for a wellbore, comprising:

expandable fracture plug seat apparatus including:

an annular array of rigid ring segments having radially inner and outer surfaces and being interdigitated with an annular array of circumferential gaps radially extending between facing end surfaces of said rigid ring segments, an annular resilient liner secured to said radially inner surfaces of said rigid segments, and a circumferentially spaced series of resilient sections extending radially outwardly from said annular resilient liner and received in said circumferential gaps, said fracture plug seat apparatus having (1) a retracted position in which said annular resilient liner has a first minimum interior diameter and said circumferential gaps have first circumferential widths, and (2) a resiliently expanded position in which said annular resilient liner has a second minimum interior diameter greater than said first minimum interior diameter, and said circumferential gaps have second circumferential widths greater than said first circumferential widths; and expansion control structure for operatively supporting said expandable fracture plug seat apparatus and selectively permitting and precluding expansion of said expandable fracture plug seat apparatus.

14. The fracturing system of claim 13 wherein:

said expansion control structure includes a locking ring coaxial with said expandable fracture plug seat apparatus, said expansion control structure being operative to selectively move said locking ring axially from a retained first position, in which diametrical expansion of said fracture plug seat apparatus is permitted, to a released position in which diametrical expansion of said fracture plug seat apparatus is blocked by said locking ring.

15. The fracturing system of claim 14 wherein:

said expansion control structure includes an outer tubular member, an inner tubular member slidably telescoped within said outer tubular member and defining therewith an annular pocket area disposed therebetween and slidably receiving said locking ring, an annular opening extending radially outwardly into said pocket area and receiving an annular peripheral portion of said expandable fracture plug seat apparatus, a first spring structure resiliently biasing said inner tubular member against said peripheral portion of said expandable fracture plug seat apparatus, a second spring structure resiliently urging said locking ring from said retained position toward said released position, and retaining structure operative to releasably retain said locking ring in said retained position.

16. A fracturing system for a wellbore, comprising:

annular fracture plug seat apparatus resiliently expandable between (1) a retracted position in which said annular fracture plug seat apparatus has a first minimum interior diameter, and (2) a resiliently expanded position in which said annular fracture plug seat apparatus has a second minimum interior diameter greater than said first minimum interior diameter; and expansion control structure for operatively supporting said annular fracture plug seat apparatus and selectively permitting and precluding expansion of said annular fracture plug seat apparatus, said expansion control structure including a locking ring coaxial with said expandable fracture plug seat apparatus, said expansion control structure being operative to selectively move said locking ring axially from a retained first position, in which diametrical expansion of said annular fracture plug seat apparatus is permitted, to a released position in which diametrical expansion of said annular fracture plug seat apparatus is blocked by said locking ring, said expansion control structure further including an outer tubular member, an inner tubular member slidably telescoped within said outer tubular member and defining therewith an annular pocket area disposed therebetween and slidably receiving said locking ring, an annular opening extending radially outwardly into said pocket area and receiving an annular peripheral portion of said annular fracture plug seat apparatus, a first spring structure resiliently biasing said inner tubular member against said peripheral portion of said annular fracture plug seat apparatus, a second spring structure resiliently urging said locking ring from said retained position toward said released position, and retaining structure operative to releasably retain said locking ring in said retained position.

17. A fracturing system for a wellbore, comprising:

an expandable fracture plug seat apparatus including:

an annular array of rigid ring segments having radially inner and outer surfaces and being interdigitated with an annular array of circumferential gaps radially extending between facing end surfaces of said rigid ring segments, said fracture plug seat apparatus having (1) a retracted position in which said radially inner surfaces define a first minimum interior diameter and said circumferential gaps have first circumferential widths, and (2) a resiliently expanded position in which said radially inner surfaces define a second minimum interior diameter greater than said first minimum interior diameter, and said circumferential gaps have second circumferential widths greater than said first circumferential widths; and an expansion control structure for operatively supporting said expandable fracture plug seat apparatus and selectively permitting and precluding expansion of said expandable fracture plug seat apparatus, the expansion control structure including a locking ring operative to selectively move from a first position, in which diametrical expansion of said annular fracture plug seat apparatus is permitted, to a second position in which diametrical expansion of said annular fracture plug seat apparatus is physically blocked by said locking ring positioned radially outwardly of said annular fracture plug seat apparatus, the locking ring being biased by a spring to preclude expansion of the expandable fracture plug seat apparatus.

18. The fracturing system of claim 17, further comprising:

an annular spring structure coaxially circumscribing said annular array of rigid ring segments, said annular spring structure resiliently urging said fracture plug seat apparatus toward said retracted position thereof.

19. The fracturing system of claim 18, wherein:

said rigid ring segments have notches formed in said radially outer surfaces thereof, and said annular spring structure extends through said notches.

20. The fracturing system of claim 18, wherein:

said annular spring structure is a garter spring.

* * * * *